US005343825A

United States Patent [19]

Gazecimeon et al.

[11] Patent Number: 5,343,825

[45] Date of Patent: Sep. 6, 1994

[54] PORTABLE SAFETY FLAG

[75] Inventors: George Gazecimeon, 880 McEachran, Outremont, Quebec, Canada, H2V 3E1; Nancy Kamisis, 39 Alie Street, Dollard-des-Ormeaux, Quebec, Canada, H9A 1G9; Richard Degroote, Montreal, Canada

[73] Assignees: George Gazecimeon; Nancy Kamisis, both of Quebec, Canada

[21] Appl. No.: 94,487

[22] Filed: Jul. 19, 1993

[51] Int. Cl.[5] ..... G09F 17/00

[52] U.S. Cl. ..... 116/173; 116/209; 362/102

[58] Field of Search ..... 116/173, 174, 175, 209; 40/586, 610; 362/102, 206

[56] References Cited

U.S. PATENT DOCUMENTS

| | | | |
|---|---|---|---|
| 2,819,547 | 1/1958 | Clements, Jr. | 40/610 |
| 3,117,549 | 1/1964 | Ripepe | 116/173 |
| 3,225,734 | 12/1965 | Bule | 116/173 |
| 3,895,348 | 7/1975 | Palermo | 116/173 X |
| 4,565,152 | 1/1986 | Bennett | 116/50 |
| 4,574,726 | 3/1986 | Sullivan | 116/28 |
| 4,800,834 | 1/1989 | Feng | 116/173 |
| 4,819,137 | 4/1989 | Hamilton | 362/102 |
| 4,944,656 | 7/1990 | Feng et al. | 116/173 |
| 5,005,512 | 4/1991 | Fu | 116/173 |
| 5,161,769 | 11/1992 | Coulthard | 248/599 |

FOREIGN PATENT DOCUMENTS

| | | | |
|---|---|---|---|
| 1939675 | 8/1969 | Fed. Rep. of Germany | 116/173 |

*Primary Examiner*—William A. Cuchlinski, Jr.
*Assistant Examiner*—Willie Morris Worth
*Attorney, Agent, or Firm*—Galgano & Burke

[57] ABSTRACT

The flag comprises a plurality of telescopic members. A knob member is connected to a tip of an inner end telescopic member and the knob member has a cross-section substantially equal to an outer base member. The knob is fastened to the base member when the flag is closed. A rod is pivotally connected to a base of the end member for radial movement away and toward the end member, and is connected to a side of a signalling sheet which is connected on its other side to the end member. The rod is biased away from the end member as the end member is extended from a remainder of the telescopic members and the rod returns to the end member as the end member is retracted into the remainder of the telescopic members. The rod holds at least part of the sheet taut when biassed away from the end member. The sheet is kept taut and visible when the telescopic members are extended, and the flag can be used to increase personal visibility, especially for small children crossing streets.

14 Claims, 2 Drawing Sheets

PORTABLE SAFETY FLAG

FIELD OF THE INVENTION

The present invention relates to a portable safety flag of the kind which may be held by a child or adult for signalling or for identification.

BACKGROUND OF THE INVENTION

When a small child crosses a street or get off a school bus, visibility of the child is a problem and accidents result when the child is unnoticed by the bus or other traffic. Solving the problem of child safety in traffic has conventionally been approached by improving the bus driver's ability to see or detect children. This approach offers certain technical difficulties and does not protect children from the perils of other traffic. Providing children with adequate means to significantly improve their visibility has not been attempted beyond suggesting that children wear bright or reflective clothing. Of course, children are reticent to wear clothing which does not suit the latest fad or fashion, and for smaller children bright clothing is simply not enough to make them visible when their height and size simply do not allow them to be easily seen from a vehicle.

U.S. Pat. Nos. 4,800,834, 4,944,656 and 5,005,512 disclose extensible flag poles or holders which have means for winding or rolling up the flag for retraction. U.S. Pat. No. 4,565,152 discloses a safety flag in which a flared base tube receives a thin rod carrying a flag, the flag being crumpled as the rod is retracted into the tube. In the known prior art, the signal flag is automatically deployed by gravity or unwinding without being held expanded for greater visibility.

There is a need for a hand held flag which is easily stored and easily deployed for use in emergency signalling as well as safety identification.

SUMMARY OF THE INVENTION

It is therefore an object of the present invention to provide a portable signal flag which is extensible and retractable for easy storage and carrying, and deploys the flag so that it is expanded for greater visibility. It is an object of the present invention to provide a hand held flag which can be used for emergency signalling or for personal safety identification. The signal flag according to the invention can be, for example, kept in the glove compartment of a vehicle or carried in the backpack of a hiker, in addition to use by school children.

According to the invention, there is provided a portable safety flag comprising a plurality of telescopic members including a base member and an end member, the base member having the largest cross-section and the end member having the smallest cross-section, a knob member connected to an extremity of the end member, the knob member having a cross-section at least as great as the base member, fastening means for fastening the knob to the base member when the flag is closed, a signalling sheet having one side connected to the end member, the sheet being flexible, a rod member pivotally connected to a base of the end member for radial movement away and toward the end member, and connected to another side of the sheet, and biassing means for biassing the rod member away from the end member as the end member is extended from a remainder of the telescopic members and for allowing the rod member to return to the end member as the end member is retracted into the remainder of the telescopic members, the rod member holding at least part of the sheet taut when biassed away from the end member.

BRIEF DESCRIPTION OF THE DRAWINGS

The invention will be better understood by way of the following non-limiting detailed description of a preferred embodiment with reference to the appended drawings, in which.

DETAILED DESCRIPTION OF THE PREFERRED EMBODIMENT

Figure 1:
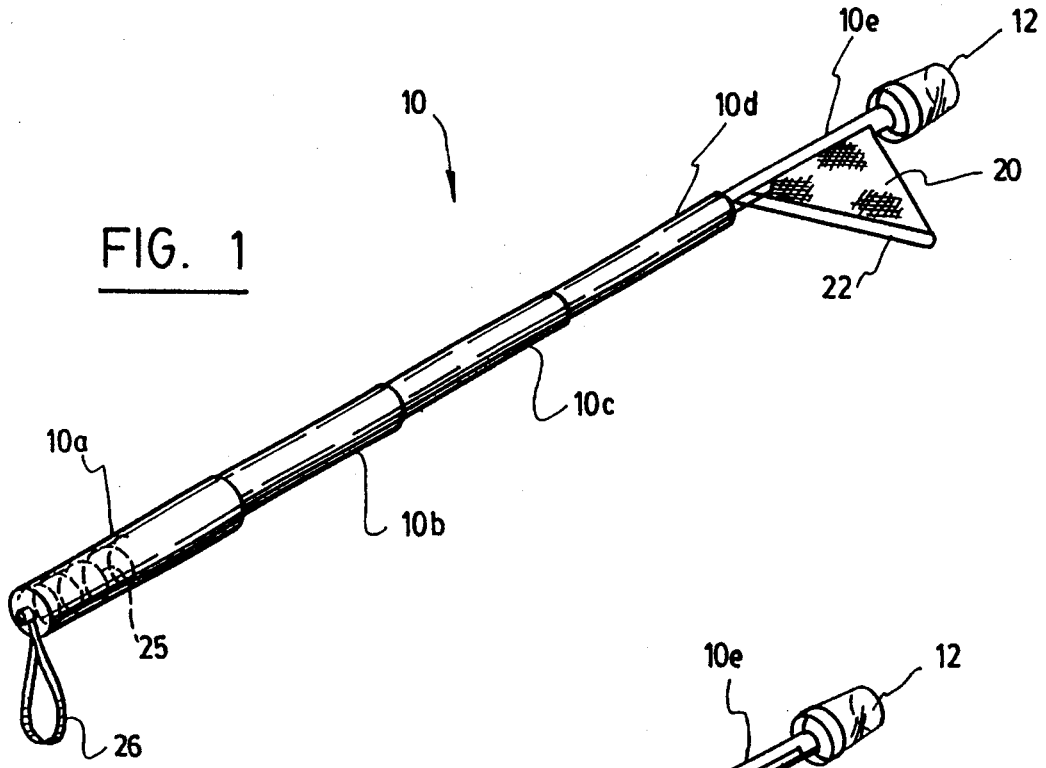
FIG. 1 is a perspective view of the preferred embodiment when fully extended and the signal flag is deployed.

As shown in FIG. 1, the hand-held safety flag comprises a plurality of telescopic members (10) which are injection molded plastic tubes with ends which press-fit or snap into one another when assembled. The end member (10*e*) is a solid plastic member provided with a knob (12) at its tip. Base member (10*a*) is provided with a strap (26) passing through a small hole in its bottom.

The signalling sheet (20), made of a fluorescently bright material, is connected along one side to member (10*e*) and along another side to rod member (22) which is pivotally connected to the bottom of end member (10*e*) and biassed outwardly, such that the sheet (20) is kept taut. The rod member (22) is a loop of wire having an inside length to which the sheet (20) is attached and a parallel outer length which is contacted by the upper end of telescopic member (10*d*) as end member (10*e*) is retracted into member (10*d*). During retraction, the force on the outer length of member (22) exerted by member (10*d*) is resiliently transferred to the inside length and pushes the inside length into recess (21) (see FIG. 4) along with sheet (20).

Figure 2:
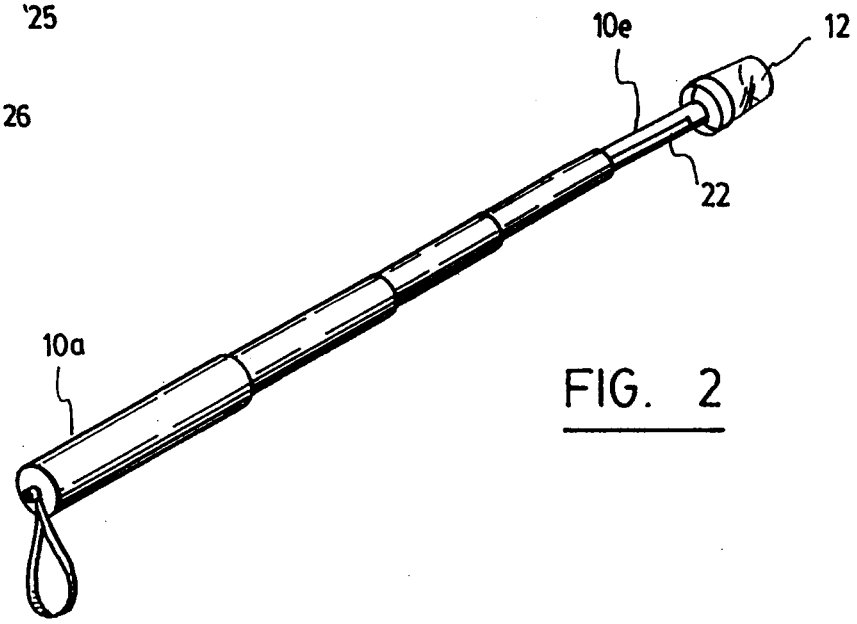
FIG. 2 is a perspective view of the preferred embodiment when partially extended an the signal flag is retracted.
Figure 3:
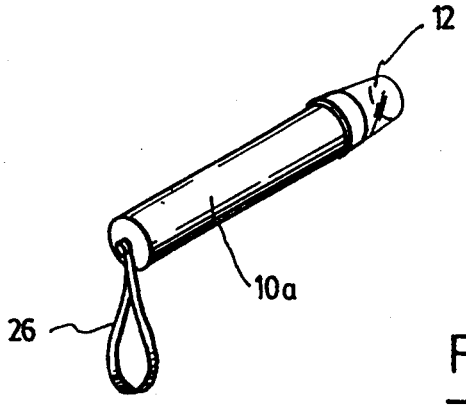
FIG. 3 is a perspective view of the preferred embodiment when closed.

As shown in FIG. 2, the safety flag is retracted as telescopic members (10) are pushed into one another, causing the retraction of the rod member (22) as described above. Knob member (12) is sized to have roughly the same cross-section as base member (10*a*) so that the safety flag has a uniform appearance and to avoid a pointed tip, as shown in FIG. 3. The knob member (12) may connect to member (10*a*) by a press-fit or a snap mechanism with knob (12) fitting over or into member (10*a*). In the preferred embodiment shown in FIG. 5, the fastening means connecting the knob (12) to base member (10*a*) includes a tab (14) which fits into a groove (16) by pushing member (10*a*) and knob (12) together, and then by rotating knob (12), tab (14) slides into lip (18).

Tab (14) will remain fixed on lip (18) by friction induced by the pressure exerted by coil spring (25) shown in FIG. 1. The spring (25) is shown to be provided in base member (10*a*) with a diameter to just fit inside member (10*a*). In this way, the base of telescopic member (10*b*) will be biassed out of base member (10*a*) when knob (12) is turned and released. Thereafter, the members (10*b*,10*c*,10*d*,10*e*) can be manually pulled to full extension. Of course, spring (25) could be provided to act between any two of the telescopic members (10).

Figure 5:
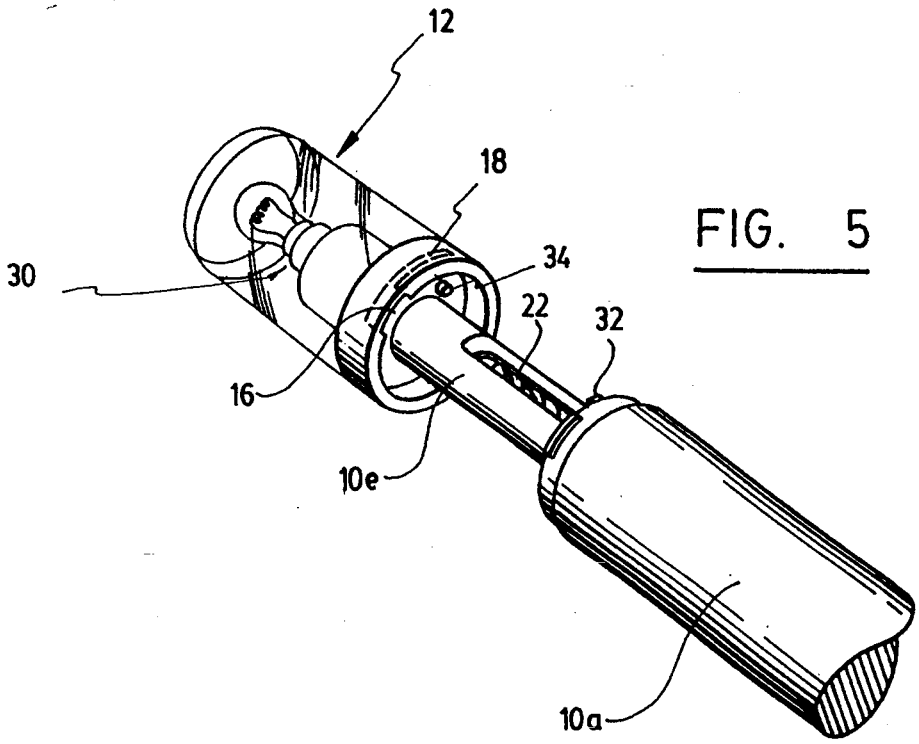
FIG. 5 is a partial perspective view of an alternative embodiment in which the knob member is provided with a safety light.

As shown in FIG. 5, knob (12) is provided with a light (30) which includes its own battery power source. A switch (34) turns on light (30) when tab (14) is not fully rotated to the end of lip (18), so that light (30) will indicate if the knob is not completely securely fastened to base member (10*a*). This is important since the safety flag may be carried by strap (26) when not in use, and ah accidental release of knob (12) from base member (10*a*) could result in damage to a lens of light (30). A protruding dimple (32) is provided at the end of base member (10*a*) which contacts the switch (34) to turn off the light (30).

Figure 4:
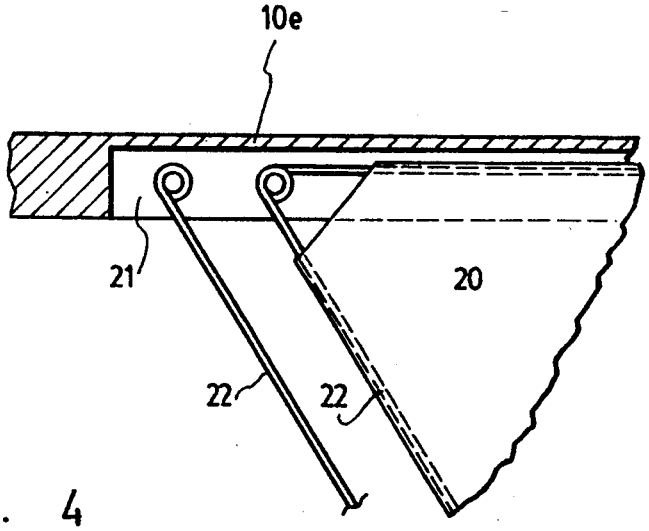
FIG. 4 is a detailed sectional view of the biassing means and the connection of the rod member to the end member.

As shown in FIG. 4, the biassing means which push rod member (22) outwardly are provided by the wire of member (22) which is wrapped around pins (24) provided in recess (21) of end member (10*e*). Of course, rod member (22) could be a rigid member and a separate spring could be provided to bias the rod member outwardly. Alternatively, the rod member could be rigid and be biassed outwardly by a lever mechanism activated as member (10*e*) is fully extended from member (10*d*). Of course, inward biassing can always be provided by the retraction of end member (10*e*) into member (10*d*), when rod member (22) is pushed towards end member (10*e*) by the upper rim of member (10*d*).

Having described the mechanics of the preferred embodiment, the preferred use of the invention will now be described. The safety flag is made mostly of light weight plastic tubes (10) and is small enough to be carried by small children. When crossing a street, e.g. after being dropped off by a school bus, a child carrying the safety flag turns knob (12) to release it from base member (10*a*). The light (30) comes on and knob (12) pops up. The knob (12) is then pulled to telescopically extend members (10) until member (10*e*) comes out of member (10*d*) and signalling sheet (20) is deployed by rod member (22). The child then holds base member (10*a*) at about shoulder height placing sheet (20) and light (30) well above the child and in full view of vehicle drivers. Once the child has safely crossed the street, the safety flag can be retracted and the light (30) turned off when the knob is securely fastened to base member (10*a*). In addition to increasing child visibility, carrying a flag increases the child's awareness of the important task being carried out, namely crossing the street safely, and may reduce the chance that the child will be careless while crossing.

We claim:

1. A portable safety flag comprising:

a plurality of telescopic members including a base member and an end member, the base member having a largest cross-section and the end member having a smallest cross-section;

a knob member connected to an end of said end member, said knob member having a cross-section substantially equal to said largest cross-section;

fastening means for fastening said knob to said base member when said flag is closed;

a signalling sheet having one side connected to said end member, said sheet being flexible;

a rod member pivotally connected to a base of said end member for radial movement away and toward said end member, and connected to another side of said sheet; and biassing means for biassing said rod member away from said end member as said end member is extended from a remainder of said telescopic members and for allowing said rod member to return to said end member as said end member is retracted into said remainder of said telescopic members, said rod member holding at least part of said sheet taut when biased away from said end member.

2. Flag as claimed in claim 1, wherein said knob member includes a light and switch means, said switch means interacting with said base member for turning said light on when said knob is disconnected from said base member, and turning said light off when said knob is connected to said base member.

3. Flag as claimed in claim 1, wherein said telescopic members have a circular cross-section.

4. Flag as claimed in claim 3, wherein a spring is provided to bias said end member away from said base member as said end member is retracted into said base member.

5. Flag as claimed in claim 4, wherein said fastening means comprise push and turn closure means cooperating between said knob and said base member for locking said knob to said base member.

6. Flag as claimed in claim 5, wherein said closure means comprise a tab provided on an outside of said base member, an axial groove provided in said knob complementary to said tab, and a circumferential lip adjacent said groove for receiving said tab, whereby said knob is pushed against said spring until said tab enters said groove and then turned until said tab rests on said lip.

7. Flag as claimed in claim 5, wherein said knob member includes a light and switch means, said switch means interacting with said base member for turning said light on when said knob is disconnected from said base member, and turning said light off when said knob is connected to said base member.

8. Flag as claimed in claim 1, wherein said rod member comprises two substantially parallel members, an inner one of said parallel members being connected to said sheet, an outer one of said parallel members for making frictional contact with an upper edge and inner surface of an adjacent one of said telescopic members.

9. Flag as claimed in claim 8, wherein said parallel members comprise an elongated resilient wire loop.

10. Flag as claimed in claim 1, wherein said end member is provided with a recess for receiving said sheet and at least partly said rod member.

11. Flag as claimed in claim 8, wherein said end member is provided with a recess for receiving said sheet and at least partly said rod member.

12. Flag as claimed in claim 9, wherein said end member is provided with a recess for receiving said sheet and at least partly said rod member.

13. Flag as claimed in claim 12, wherein said telescopic members have a circular cross-section.

14. Flag as claimed in claim 1, wherein said base member is provided with a wrist loop at an end opposite said knob for carrying said flag when retracted with said knob hanging down.

* * * * *